United States Patent [19]

Ludy

[11] 4,270,587

[45] Jun. 2, 1981

[54] NAIL HOLDER FOR HAMMERS

[76] Inventor: Andrew W. Ludy, 17 Sherwood Way, Landing, N.J. 07850

[21] Appl. No.: 63,052

[22] Filed: Aug. 2, 1979

[51] Int. Cl.[3] ..... B25C 1/00

[52] U.S. Cl. ..... 145/30 R

[58] Field of Search ..... 145/30 R

[56] References Cited

U.S. PATENT DOCUMENTS

| | | | |
|---|---|---|---|
| 698,631 | 4/1902 | Carlisle | 145/30 R |
| 845,823 | 3/1907 | Schmidt | 145/30 R |
| 951,646 | 3/1910 | Lambert | 145/30 R |
| 1,379,838 | 5/1921 | Salomaa | 145/30 R |
| 1,695,339 | 12/1928 | Lochhead | 145/30 R |

FOREIGN PATENT DOCUMENTS

| | | | |
|---|---|---|---|
| 203924 | 9/1920 | Canada | 145/30 R |
| 111558 | 12/1917 | United Kingdom | 145/30 R |

*Primary Examiner*—Othell M. Simpson
*Assistant Examiner*—J. T. Zatarga
*Attorney, Agent, or Firm*—Samuelson & Jacob

[57] ABSTRACT

A nail holder for hammers is clipped to a hammer beneath the hammer head and includes a pair of juxtaposed, generally coextensive cantilever members of spring material having overlapping free ends which are located adjacent the hammer head and are resiliently biased toward one another to clamp the head of a nail gently between the free ends, with the shank of the nail projecting generally perpendicular to the cantilever members, in position for starting the nail, especially in relatively soft materials, the free ends facilitating freedom of movement of the free ends and selective release of the nail head from between the free ends subsequent to starting of the nail without disturbing the started purchase of the nail.

8 Claims, 22 Drawing Figures

NAIL HOLDER FOR HAMMERS

The present invention relates generally to attachments for tools and pertains, more specifically, to a nail holder for attachment to a hammer to enable a nail to be held in place adjacent the head of the hammer for starting the nails in a naildriving operation, and especially in connection with the starting of nails in relatively soft materials, or in delicate work.

Nail holding attachments for hammers are known and have taken a variety of configurations in the past. Some examples of nail holers in the prior art are found in the following U.S. Pat. Nos.:

Carlisle, Pat. No. 698,631, illustrates a nail holding attachment in the form of a spring sheet metal strip bent upon itself to establish a bifurcated member adapted to hold the head of a nail near the bend in the strip and against a socket portion of the head of the hammer to which the device is attached. Once started, the nail head is released by raising the hammer to slip the nail head from beneath the bifurcated member.

Johnson, Pat. No. 903,095, employs a spring clip to hold a nail upon a hammer head with the nail projecting forward for starting. Release of the started nail requires raising the hammer to release the nail from a spring clip.

Lambert, Pat. No. 951,646, also employs a spring clip which carries a wire nail holder for locating a nail against a hammer head for starting. Here too, the hammer is raised to release the started nail.

Vigil, Pat. No. 2,574,304, shows a nail-holding attachment in which a V-shaped notch receives and retains a nail against the head of a hammer and from which the nail is released by lowering the hammer from the started nail.

In using a nail holder of the type described, a nail is placed within the holder such that the head of the nail is clamped therein, the nail is started by an initial stroke of the hammer toward the work, and then the nail is detached from the holder by manipulating the hammer and nail holder to release the nail head from the clamped engagement. In the starting of nails in relatively soft materials, such as gypsum wall boards which have become so prevalent in the current dry wall construction of buildings, it becomes necessary not only to hold the nail with enough rigidity for starting, but to enable easy release of the clamped nail head so as not to disturb the relatively insecure initial purchase attained by a started nail in the soft materials. In each of the above-outlined prior art devices, a nail is held with some tenacity and no structure is presented which would indicate that the problem of easy release of the nail for the preservation of a purchase in relatively soft materials has been considered. Additionally, starting of a nail is to be accomplished is such prior devices by a single blow and no structure is presented for accommodating a plurality of delicate taps for the delicate start of a nail.

It is therefore an object of the present invention to provide a nail holder construction in which a nail is held positively in appropriate position for starting, but is released readily after starting so as not to disturb even an insecure purchase of a nail started in a relatively soft material.

Another object of the invention is to provide a nail holder of the type described and in which slight inadvertent movements of the hammer, subsequent to starting of the nail and prior to release of the nail from the nail holder, and tending to dislodge the nail from the started purchase, are accommodated without disturbing the purchase of the started nail.

Still another object of the invention is to provide a nail holder of the type described and in which a nail may be started in delicate work with a series of successive delicate taps, rather than a single blow, without disturbing the purchase of the started nail.

Yet another object of the invention is to provide a nail holder of the type described and which is attached readily to hammers of various sizes and configurations so as to be essentially universal in use.

A further object of the invention is to provide a nail holder of the type described and which is easy to use under a wide variety of conditions in the field.

A still further object of the invention is to provide a nail holder of the type described and which has a simplified configuration capable of economical manufacture in large numbers of high quality.

Yet a further object of the invention is to provide a nail holder of the type described and which is rugged in construction so as to provide reliable performance over an extended service life.

The above objects, as well as further objects and advantages, are attained by the present invention which may be described briefly as a nail holder for gently holding a nail, having a head and a shank, juxtaposed with the head of a hammer for the purpose of starting the nail, especially in relatively soft materials, and selectively releasing the nail without disturbing the started purchase, the nail holder comprising: a first cantilever member of resilient spring material extending between opposite first and second ends and having a notch including an entrance opening at the first end and extending along the first cantilever member for a relatively short distance in a longitudinal direction toward the second end for receiving the shank of the nail and locating the nail closely adjacent the first end of the first cantilever member; a second cantilever member of resilient spring material extending generally coextensive with the first cantilever member between opposite first and second ends, the first end of the second cantilever member being juxtaposed with the first end of the first cantilever member and including a portion overlapping the notch therein, the first ends being resiliently biased toward one another by virtue of the resiliency of the spring material of the cantilever members such that the head of the nail whose shank is received in the notch will be clamped gently between the first ends, and the shank will project in a given direction generally perpendicular to the cantilever members; the first and second cantilever members being joined at the second ends thereof, the cantilever members each having a length great enough to provide sufficient flexibility to enable relatively free movement of the first ends relative to the second ends and relative to one another in the given direction in which the nail shank projects; and attachment means at the second ends for attaching the cantilever members to the hammer, with the second ends located below the hammer head and the cantilever members extending upwardly to place the first ends in juxtaposition with the hammer head, whereby movement of the hammer head in a direction parallel to the given direction will enable starting of the nail and movement of the hammer head downwardly in the direction parallel to the longitudinal direction of extent of the notch will enable selective release of the nail head from between the first ends without disturbing the started purchase of the nail.

The invention will be more fully understood, while still further objects and advantages will become apparent, in the following detailed description of preferred embodiments thereof illustrated in the accompanying drawing, in which.

Figure 1:
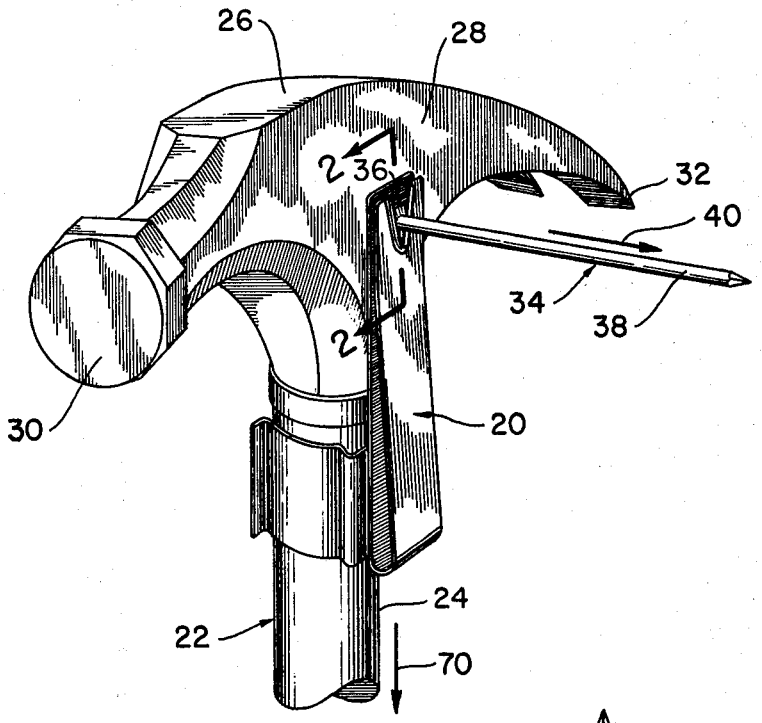
FIG. 1 is a perspective view of a hammer to which there is attached a nail holder constructed in accordance with the invention.
Figure 2:
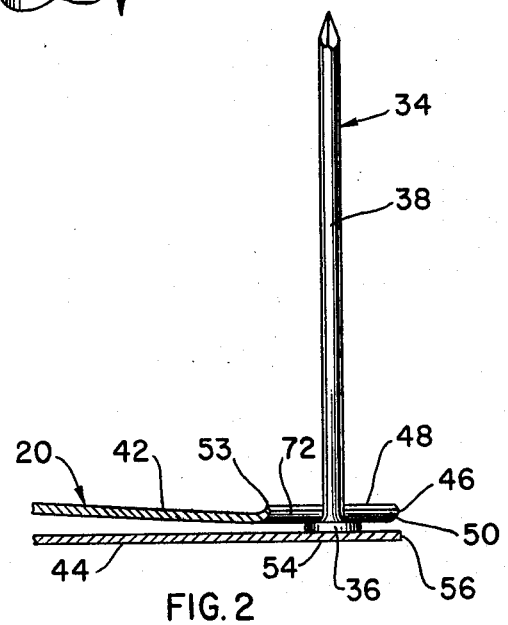
FIG. 2 is an enlarged, fragmentary cross-sectional view taken along line 2—2 of FIG. 1.
Figure 3:
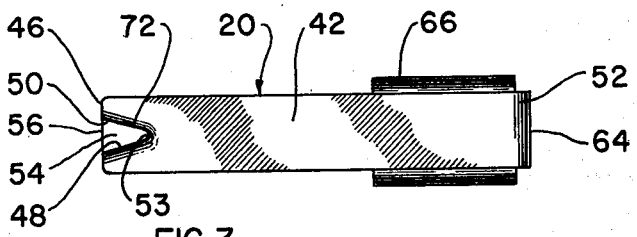
FIG. 3 is a top plan view of the nail holder.
Figure 6:
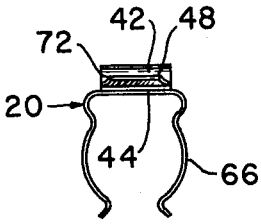
FIG. 6 is a left side view of the nail holder.
Figure 4:
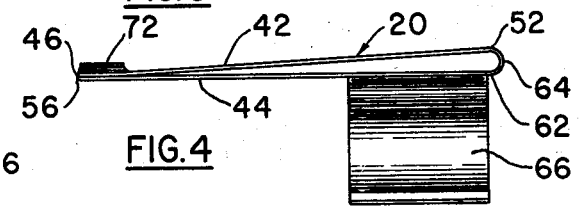
FIG. 4 is a front elevational view of the nail holder.
Figure 7:
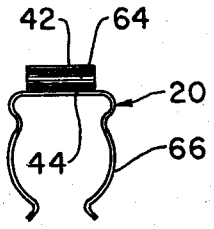
FIG. 7 is a right side view of the nail holder.
Figure 5:
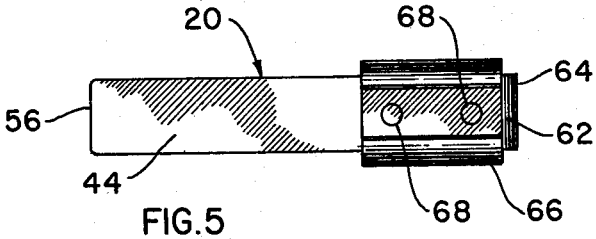
FIG. 5 is a bottom plan view of the nail holder.
Figure 8:
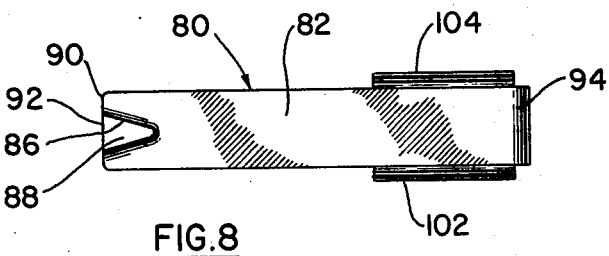
FIG. 8 is a top plan view of another nail holder constructed in accordance with the invention.
Figure 11:
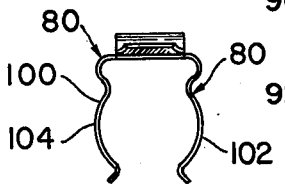
FIG. 11 is a left side view of the nail holder of FIG. 8.
Figure 9:
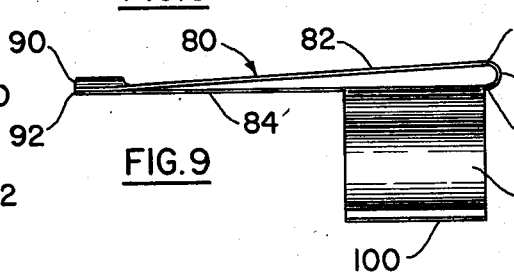
FIG. 9 is a front elevational view of the nail holder of FIG. 8.
Figure 12:
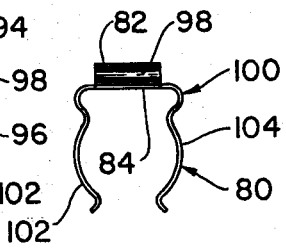
FIG. 12 is a right side view of the nail holder of FIG. 8.
Figure 10:
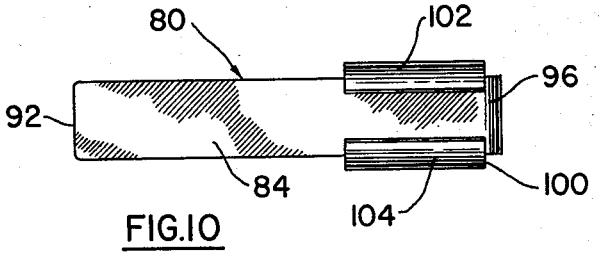
FIG. 10 is a bottom plan view of the nail holder of FIG. 8.
Figure 13:
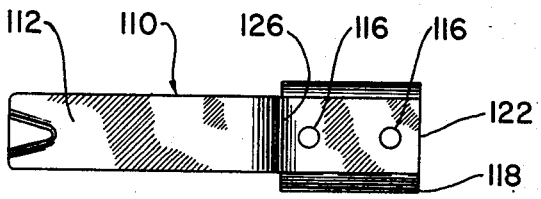
FIG. 13 is a top plan view of still another nail holder constructed in accordance with the invention.
Figure 16:
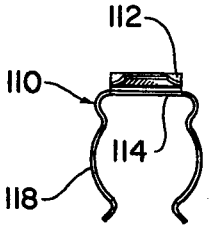
FIG. 16 is a left side view of the nail holder of FIG. 13.
Figure 14:
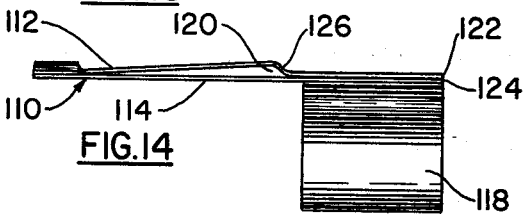
FIG. 14 is a front elevational view of the nail holder of FIG. 13.
Figure 17:
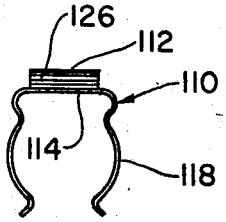
FIG. 17 is a right side view of the nail holder of FIG. 13.
Figure 15:
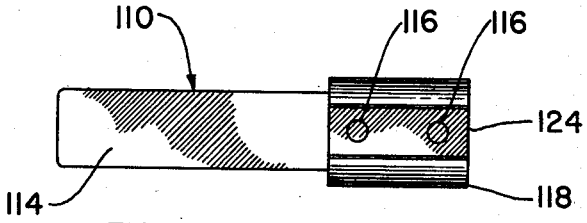
FIG. 15 is a bottom plan view of the nail holder of FIG. 13.
Figure 18:
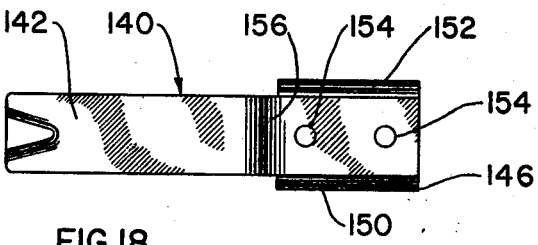
FIG. 18 is a top plan view of yet another nail holder constructed in accordance with the invention.
Figure 21:
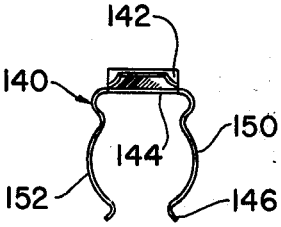
FIG. 21 is a left side view of the nail holder of FIG. 18.
Figure 19:
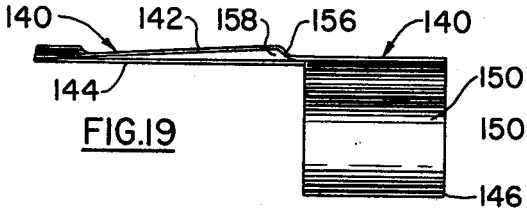
FIG. 19 is a front elevational view of the nail holder of FIG. 18.
Figure 22:
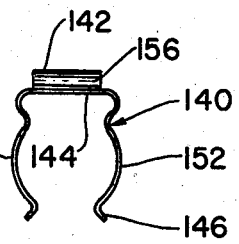
FIG. 22 is a right side view of the nail holder of FIG. 18.
Figure 20:
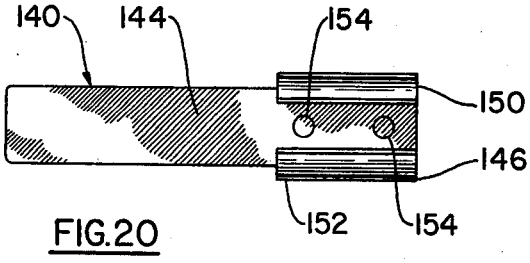
FIG. 20 is a bottom plan view of the nail holder of FIG. 18.

Referring now to the drawing, and especially to FIGS. 1 and 2 thereof, a nail holder constructed in accordance with the invention is shown at 20 and is seen to be attached to a hammer 22 having a handle 24 and a head 26. Head 26 includes a side face 28, as well as a striking nose 30 and a claw 32. A nail 34, which includes a head 36 and a shank 38, is held by the nail holder 20 in appropriate position for starting; that is, the head 36 of nail 34 is held adjacent the side face 28 of hammer head 26 and the shank 38 projects generally perpendicular to the side face 28 so that a stroke of the hammer 22 in the direction in which the shank 38 projects, as illustrated by arrow 40 in FIG. 1, will drive the nail 34 for starting purposes.

Turning now to FIGS. 3 through 7, as well as to FIGS. 1 and 2, nail holder 20 includes first and second cantilever members 42 and 44, respectively, juxtaposed with one another so as to be generally coextensive along the lengths thereof. Cantilever member 42 includes a first end 46 and a notch 48 having an entrance opening 50 at end 46 and extending along the cantilever member 42 for a relatively short distance in a longitudinal direction toward the second end 52 of the cantilever member 42 to terminate at 53. The second cantilever member 44 includes a portion 54 at first end 56 which overlaps the notch 48 in the first cantilever member 42 so that the head 36 of the nail 34 is captured between the cantilever members 42 and 44 adjacent the ends 46 and 56 thereof with the shank 38 of the nail 34 projecting generally perpendicular to the cantilever members 42 and 44.

Cantilever members 42 and 44 are joined at second ends 52 and 62 thereof, in this instance by a connecting end wall 64 which is unitary with the cantilever member 42 and 44 at the second ends 52 and 62 and serves to space the cantilever members 42 and 44 apart slightly adjacent the second ends 52 and 62, for purposes which will be explained below. A spring clip 66 is affixed to the second cantilever member 44, adjacent second end 62 thereof, as by spot welds 68 (see FIG. 5), and serves an an attachment means for attaching the nail holder 20 to the hammer 22. Spring clip 66 is located to grasp the handle 24 of the hammer 22 just below the head 26 of the hammer 22 so that the cantilever members 42 and 44 extend upwardly to place the first ends 46 and 56 in juxtaposition with the side face 28 of the hammer head 26. Spring clip 66 has sufficient flexibility to enable attachment to hammers of various sizes.

Cantilever members 42 and 44 are constructed of a resilient spring material, preferably a spring metal such as steel or copper, which enables the nail head 36 to be captured firmly, but gently, between the ends 46 and 56 of the cantilever members 42 and 44. The resiliency of the material of the cantilever members, coupled with the length between the first ends 46 and 56, where the nail is captured, and the ends 52 and 62, where the cantilever members are joined together, enable the first ends 46 and 56 to be resilienty biased toward one another for gently clamping the head 36 of nail 34 between the ends 46 and 56 while providing sufficient flexibility so that the first ends 46 and 56 are free to move relative to the second ends 52 and 62 and relative to one another in directions parallel to the direction of arrow 40 in FIG. 1. Such freedom of movement of both of the first ends 46 and 56 relative to the second ends 52 and 62 will enable slight movements of the hammer in directions parallel to the arrow 40, subsequent to starting of the nail 34, without dislodging the started nail 34 from its purchase within the material in which the nail is started. Thus, even where the material within which the nail 34 is started is a relatively soft material, such as common gypsum wall board or soft acoustic ceiling and wall materials, the delicate purchase of the started nail need not be disturbed by inadvertent manipulations of the hammer 22 subsequent to starting the nail 34 but prior to releasing the started nail from the nail holder 20. These movements can be absorbed by the flexible resilient nature of the cantilever members 42 and 44 without disturbing the starting purchase of the nail 34. In addition, in carrying out delicate work where it would not be feasible to start a nail with a single, hard blow of the hammer, a nail may be started by a series of delicate taps. Slight movement of the hammer between successive taps in such a series is enabled without disrupting the purchase of the started nail by virtue of the freedom of movement of the first ends 46 and 56 of the cantilever members 42 and 44 relative to the second ends 52 and 62.

The freedom of movement of the first ends 46 and 56 relative to one another enables easy selective release of the captured head 36 of nail 34 from between the ends 46 and 56, subsequent to starting of the nail, by merely moving the hammer 22 downwardly, in the direction of arrow 70 in FIG. 1, generallly perpendicular to the direction in which the nail projects and parallel to the direction in which notch 48 extends so as to release the nail head 36 and detach the nail 34 from the nail holder 20. The spacing provided between the cantilever members 42 and 44 at the second ends 52 and 62 serves to facilitate the movement of the first ends 46 and 56 relative to one another while maintaining a resilient biasing force tending to urge the first ends 46 and 56 toward one another for gently holding the captured nail head 36 with the nail 34 in an appropriate starting position.

Notch 48 is provided with a V-shaped configuration which tapers from the wider entrance opening 50 toward the narrow termination 53 so as to accommodate nails having shanks of different diameters. In order to provide a more stable grip on the captured nail, notch 48 is provided with a flared edge 72 which follows the contour of the nail 34 adjacent the intersection of the head 36 and the shank 38 and thereby grasps the nail in a more positive manner. Flared edge 72 also enables ease of insertion of the nail 34 between the ends 46 and 56 by virture of the engagement of head 36 with the flared edge 72 to lift end 46 from end 56.

Thus, nail holder 20 provides a gentle hold for nail 34 enabling the starting of the nail in a relatively soft material and subsequent selective release of the nail from the holder without disturbing the delicate purchase of the started nail in the soft material. Additionally, inadvertent slight movements of the hammer 22, subsequent to starting of the nail and prior to release of the nail, which movements could tend to dislodge the nail from its started purchase, are enabled by the flexibility and resilience of the cantilever members 42 and 44 without disrupting either the grip of the nail holder on the nail or the purchase of the started nail. Thus, in the execution of delicate work, a nail may be started by a plurality of successive delicate taps, rather than relying upon a single blow to start the nail.

Referring now to FIGS. 8 through 12, another nail holder constructed in accordance with the invention is shown at 80. Nail holder 80 is very similar to the above-described nail holder 20 in that a pair of flexible resilient cantilever members 82 and 84 are provided for holding a nail adjacent the head of a hammer, utilizing a notch 86 overlapped by a portion 88 to capture a nail head at the first ends 90 and 92 of the cantilever members 82 and 84. The opposite second ends 94 and 96 of the cantilever members 82 and 84 are joined by a unitary end wall 98 and are spaced apart slightly by the end wall 98.

In the present nail holder 80, however, the attachment means comprises a spring clip 100 which includes a pair of sring arms 102 and 104 both of which are formed unitary with the second cantilever member 84. Thus, the entire construction is a one-piece unitary structure requiring no assembly of component parts during manufacture.

Turning now to FIGS. 13 through 17, a further nail holder constructed in accordance with the invention is shown at 110. Nail holder 110 is similar in operation to the above-described nail holders 20 and 80, but is somewhat different in construction in that flexible cantilever members 112 and 114 are fabricated separately and are each affixed, as by welds 116, to a spring clip 118 to establish an integral, though not unitary, structure. Cantilever members 112 and 114 are spaced apart slightly at 120, adjacent the affixed ends 112 and 124 of the cantilever members, by virtue of a spacer wall 126 formed as a part of cantilever member 112.

A still further embodiment of the invention is illustrated in FIGS. 18 through 22 wherein a nail holder 140 is shown having a pair of cantilever members 142 and 144 and a spring clip 146. In this instance, the spring clip 146 includes a pair of spring arms 150 and 152 which are formed unitary with the second cantilever member 144. The first cantilever member 142 is affixed to the second cantilever member 144 and spring clip 146, as by welds 154. A spacer wall 156, formed as a part of the first cantilever member 142, spaces the first cantilever member 142 from the second cantilever member 144 at 158.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A nail holder for gently holding a nail, having a head and a shank, juxtaposed with the head of a hammer for the purpose of starting the nail, especially in relatively soft materials, and selectively releasing the nail without disturbing the started purchase, said nail holder comprising:

a first cantilever member of resilient spring material extending between opposite first and second ends and having a notch including an entrance opening at the first end and extending along the first cantilever member for a relatively short distance in a longitudinal direction toward the second end for receiving the shank of the nail and locating the nail closely adjacent the first end of the first cantilever member;

a second cantilever member of resilient spring material extending generally coextensive with the first cantilever member between opposite first and second ends, the first end of the second cantilever member being juxtaposed with the first end of the first cantilever member and including a portion overlapping the notch therein, said first ends being resiliently biased toward one another by virtue of the resiliency of the spring material of the cantilever members such that the head of the nail whose shank is received in the notch will be clamped gently between the first ends, and the shank will project in a given direction generally perpendicular to the cantilever members;

the first and second cantilever members being joined at the second ends thereof, the cantilever members each having a length great enough to provide sufficient flexibility to enable relatively free movement of the first ends relative to the second ends and relative to one another in the given direction in which the nail shank projects; and attachment means at the second ends for attaching the cantilever members to the hammer, with the second ends located below the hammer head and the cantilever members extending upwardly to place the first ends in juxtaposition with the hammer head, whereby movement of the hammer head in a direction parallel to the given direction will enable starting of the nail and movement of the hammer head downwardly in the direction parallel to the longitudinal direction of extent of the notch will enable selective release of the nail head from between the first ends without disturbing the started purchase of the nail.

2. The invention of claim 1 wherein the first and second cantilever members are spaced apart slightly adjacent the second ends to facilitate the movement of the first ends relative to one another while maintaining the resilient bias of the first ends toward one another for gentle holding of the nail.

3. The invention of claim 1 wherein the attachment means comprises a spring clip integral with the cantilever members adjacent the second ends thereof.

4. The invention of claim 1 wherein the first and second cantilever members comprise a unitary structure in which the cantilever members are joined at the second ends thereof.

5. The invention of claim 4 wherein the attachment means comprises a spring clip unitary with the unitary structure.

6. The invention of claim 5 wherein the spring clip is unitary with the second cantilever member adjacent the second end thereof.

7. The invention of claim 1, 2, 3, 4, 5 or 6 wherein the notch has a V-shaped configuration for accommodating nail shanks of various diameters.

8. The invention of claim 7 wherein the perimeter of the V-shaped configuration includes a flared edge for accommodating the surface contour of the nail adjacent the intersection of the nail head and shank while maintaining the gentle holding of the nail.

* * * * *